United States Patent [19]

Hehn

[11] Patent Number: 4,979,676

[45] Date of Patent: Dec. 25, 1990

[54] FUEL INJECTION DEVICE FOR INTERNAL COMBUSTION ENGINES

[75] Inventor: Lucien Hehn, Villeurbanne, France

[73] Assignee: Robert Bosch GmbH, Stuttgart, Fed. Rep. of Germany

[21] Appl. No.: 424,461

[22] Filed: Oct. 20, 1989

[30] Foreign Application Priority Data

Dec. 31, 1988 [DE] Fed. Rep. of Germany ..... 3844431

[51] Int. Cl.[5] ..... F02M 57/02

[52] U.S. Cl. ..... 239/95; 239/124; 239/533.8

[58] Field of Search ..... 239/90, 91, 93, 94, 239/95, 124, 533.8

[56] References Cited

U.S. PATENT DOCUMENTS

| | | | |
|---|---|---|---|
| 2,536,542 | 1/1951 | Evans et al. | 299/107.6 |
| 3,075,707 | 1/1963 | Rademaker | 239/90 |
| 3,115,304 | 12/1963 | Humphries | 239/90 |
| 4,279,385 | 7/1981 | Straubel et al. | 239/90 |
| 4,598,863 | 7/1986 | Kanesaka | 239/94 |
| 4,684,067 | 8/1987 | Cotter et al. | 239/533.3 |

FOREIGN PATENT DOCUMENTS 636098 4/1950 United Kingdom .

*Primary Examiner*—Andres Kashnikow
*Assistant Examiner*—Karen B. Merritt
*Attorney, Agent, or Firm*—Edwin E. Greigg

[57] ABSTRACT

A fuel injection device for internal combustion engines having a high-pressure pump with a pump work chamber having a fuel injection valve with a pressure chamber, a pressure line connecting the pressure chamber with the pump work chamber. A relief conduit controlled by a relief valve which automatically blocks the relief conduit during the high-pressure phase and opened upon the beginning of the cutoff, for increasing a closing pressure exerted on the fuel injection valve after the end of the injection operation. The pressure line includes a pressure valve which opens in the supply direction and closes upon the beginning of the cutoff. The relief valve is urged in the opening direction by the pressure in the pressure chamber in the high-pressure chamber phase, and opens during flow of fuel from chamber in a direction toward the spring chamber of the injection valve simultaneously with a decrease in pressure in the pump work chamber.

20 Claims, 2 Drawing Sheets

FUEL INJECTION DEVICE FOR INTERNAL COMBUSTION ENGINES

BACKGROUND OF THE INVENTION

The invention is based on a fuel injection device for internal combustion engines. In fuel injection devices of this type, the injection quantity is controlled either by means of control edges or via a magnet valve. In the case of the end of supply determined by the control edge or by opening of the magnet valve, a particularly problematic feature is that the valve needle does not close immediately, because the pressure cannot be reduced fast enough, because the line lengths and cross sections, and/or because the valve needle rises from its seat again because of reverse pressure waves in the lines. This has the disadvantage that fuel continues to be injected after the cutoff operation has already been completed. The result is increased harmful exhaust emissions. Furthermore, exhaust gases may get from the combustion chamber into the injection nozzle, which rapidly plugs the nozzle openings with carbon and causes deposits of soot particles.

The closing speed and closing quality of the injection valve needle can be increased, in a known manner, by increasing the closing pressure on the injection valve needle at the end of injection.

For instance, in a known injection device (German Patent No. 879 936), the valve closing spring is supported on its end remote from the nozzle needle on a piston that is acted upon on the other end with fuel from the pressure line via a fuel relief line provided with check valves disposed in contrary directions; this fuel simultaneously acts upon the valve needle in the opening direction. During the pump piston compression stroke, the closing spring of the valve needle is as a result more markedly pre-stressed via this piston, which leads to an increase in the closing pressure even during the injection process.

In another known injection device (U.S. Pat. No. 3,115,304) having a control edge for fuel quantity metering, the relief line is opened simultaneously with a diversion conduit of the pump work chamber. In the diversion or cutoff, the diverted fuel is directed via the relief line into the spring chamber, which increases the closing pressure. To assure a pressure reduction in the pressure chamber, the pressure valve has a valve plate with a throttle bore, for damping the diversion pressure, which because of the throttle bore does not assure adequate sealing of the pressure chamber with respect to the pump work chamber during the intake stroke.

In another known injection device (U.S. Pat. No. 3,075,707), which however belongs to the same generic type and likewise functions mechanically, the attempt is made to overcome this deficiency by using a plate valve, which during the compression stroke of the pump piston closes a relief line between the pump work chamber and the closing spring chamber, and upon cutoff or the intake stroke of the pump piston uncovers this relief line or its inlet opening to the spring chamber and closes it with respect to the pump work chamber.

Normally, a pressure valve serves to decouple the pump work chamber from the pressure chamber of the injection valve hydraulically during the intake stroke, to avoid undesirable pressure influence. Additionally, in electrically controlled injection pumps, this also prevents any existing pressure in the pressure line after the closure of the valve needle from recoiling on the magnet valve, which could cause its destruction or at least could cause inaccurate metering.

In each case, it is attained that a high injection pressure already prevails at the injection onset, which is good for the atomization or preparation of the fuel. Furthermore, it is attained that the pressure chamber of the valve needle is disconnected from the work chamber of the pump piston in the intake stroke, so that no negative pressure is produced in the pressure chamber from the intake stroke, which would have a deleterious effect on the opening characteristic of the valve needle in the ensuing compression stroke. In the provisions of the known injection device, where this reversal and the sealing off of the pump work chamber from both the pressure chamber and the valve closing spring chamber represents a compromise, the disadvantages noted initially above are still not overcome, because a clear separation between the functions of the pressure valve and the relief valve is not possible. During the switchover of the plate valve, uncontrollable leakage flows arise, which prevent accurate fuel quantity metering. A further disadvantage of this injection device is that with the relief line opened and fuel flowing out, a negative pressure is produced at the plate valve by the flow, and this impairs the sealing of the pump work chamber.

OBJECT AND SUMMARY OF THE INVENTION

The fuel injection device according to the invention has an advantage over the prior art that although the relief valve is blocked in the compression stroke by the pump pressure, after the end of supply of the injection pump the pressure from the pressure chamber of the injection nozzle is carried directly, and cleanly separated from the pump work chamber, into the spring chamber. Immediately after the beginning of the cutoff the pressure chamber is separated from the piston work chamber by the pressure valve. The pressure valve, which closes securely and tightly because of the spring loading, additionally prevents the production of a negative pressure in the pressure line during the pump piston intake stroke and in the pressure chamber on the valve needle, which would impair the ensuing injection operation. During the compression stroke of the pump piston, a negative pressure cannot arise in the pressure line and in the pressure chamber, either, if the pressure in the pressure chamber has been reduced via the relief conduit.

Simultaneously with the closure of the pressure valve, the relief conduit is uncovered by the relief valve, and the fuel, still at high pressure, flows out of the pressure chamber via the relief conduit into the spring chamber of the valve closing spring, as a result of which the closing pressure on the valve needle is increased and the closing process is accelerated. At the same time, by the outflow of the fuel, the pressure line and the pressure chamber on the valve needle are pressure-relieved, which again accelerates the process of closing of the valve needle.

Pressure waves that may arise in the closing operation because of the sudden pressure drop can neither be reflected into the pressure chamber, nor conversely, with electrically controlled injection pumps, penetrate to the magnet valve, because the pressure valve closes the fuel inflow line. The pressure waves are instead carried via the relief conduit into the spring chamber of the injection valve, where they reinforce the closing operation.

In a further advantageous feature of the invention, the movable valve element of the relief valve is radially sealingly and axially displaceably guided, and on one end is provided with a valve sealing face cooperating with a fixed valve seat and on the other is acted upon by the pressure of the pump work chamber. This has the advantage that the relief valve, with the end of injection initiated by the pressure drop in the pump work chamber, is easily opened by the pressure in the pressure chamber and uncovers the relief conduit.

In a further advantageous feature of the invention, the movable valve element of the relief valve is loaded by a closing spring. This has the advantage that the relief valve securely closes the relief conduit during the pump piston compression stroke.

In a further advantageous feature of the invention, the relief valve is disposed near the pump work chamber. As a result, short line lengths are attained, which have the advantage of having a small idle volume.

In another advantageous feature of a fuel injection device according to the invention, having a leakage line from the spring chamber, a throttle is provided in the leakage line. This has the advantage that the pressure in the spring chamber is maintained during the diversion operation, in order to increase the closing pressure.

In a further advantageous feature of the invention, the pressure valve and the relief valve are disposed parallel to one another, but in opposite directions, in an intermediate plate, and both the seat face and the spring site of each valve are acted upon on one side from the pump work chamber and on the other from the pressure chamber. This has the advantage that the line lengths can be kept short, and the installation of the valves is particularly simple and hence economical.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
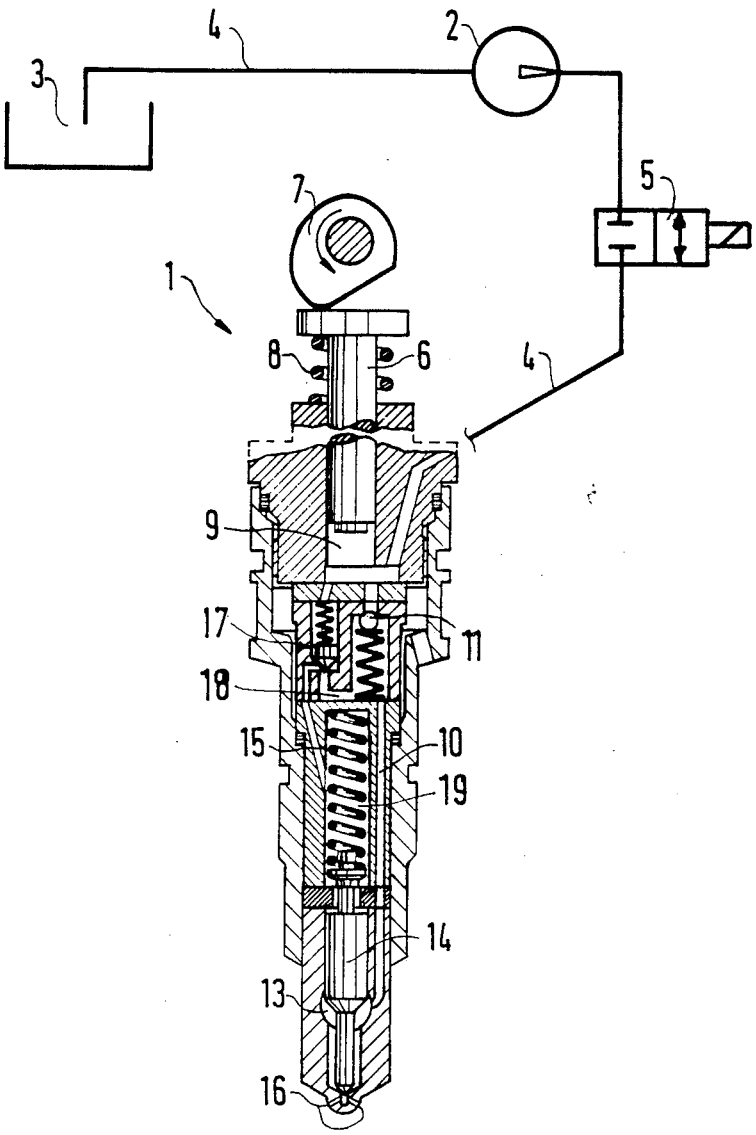
FIG. 1 is a longitudinal, sectional view of a simplified unit fuel injector in an embodiment according to the invention.
Figure 2:
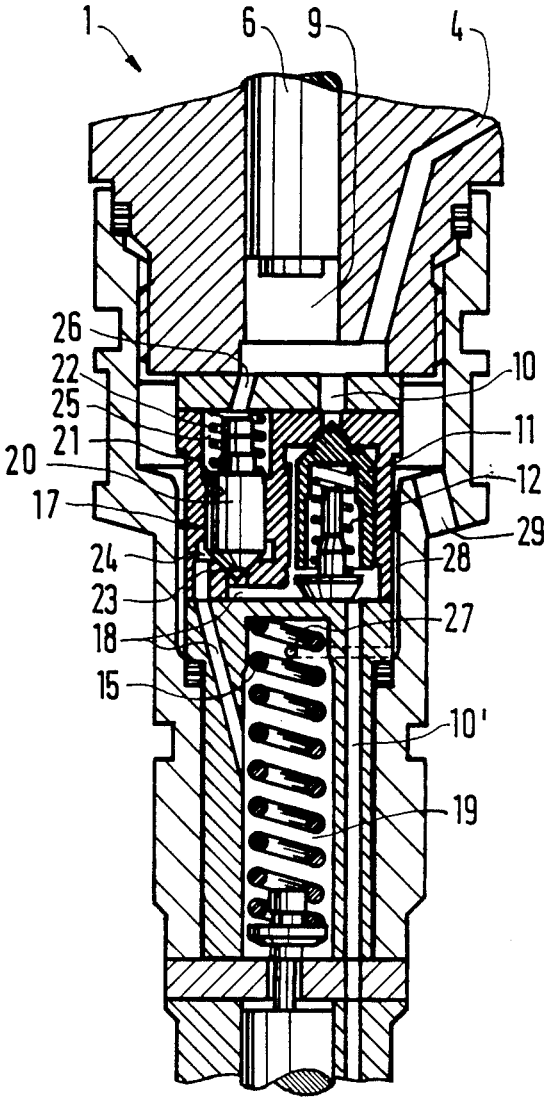
FIG. 2 is a detail of a portion of FIG. 1, on a larger scale.

In the fuel injection device shown in the drawing, a unit fuel injector 1 is supplied with fuel via a feed pump 2 from a fuel container 3; a magnet valve 5 that controls the fuel quantity to the unit fuel injector 1 is disposed in a fuel line 4.

The unit fuel injector 1 has a pump piston 6, which is actuated via a cam 7 counter to the force of a spring 8 and defines a pump work chamber 9. From the pump work chamber 9, a pressure line 10 leads, via a pressure valve 11 loaded by a spring 12 which closes the valve toward the pump work chamber 9. The pressure line 10 leads to a pressure chamber 13 of an injection nozzle, in which chamber, a valve needle 14 operates, which given sufficiently high injection pressure is displaced counter to the force of a closing spring 15 and thereby uncovers injection openings 16, so that the fuel reaches the combustion chamber of the engine.

In addition to the pressure valve 11, a one-way relief valve 17 is provided, which controls a relief conduit 18 between the pressure line 10 and the spring chamber 19 of the closing spring 15. The valve element 20 of the relief valve 17 is guided in form-fitting fashion in a stepped housing bore 21 and is forced into a valve seat 23 by the force of an associated closing spring 22, thereby closing the relief conduit 18. Downstream of the valve seat 23, the housing bore 21 is enlarged to form an annular chamber 24. The spring chamber 25 of the closing spring 22 communicates with the pump work chamber 9 via a further pressure line 26, and acts upon the valve element 20 with the pressure prevailing therein.

For pressure relief of the spring chamber 19, a throttle 27 is provided, which leads from the spring chamber 19 into an annular chamber 28 that communicates via a housing bore 29 with a return line, not shown.

During the upward intake stroke of the pump piston 6, fuel flows under control of the magnet valve 5 via the fuel line 4 into the pump work chamber 9. The two valves 11 and 17 are at this time closed. In the ensuing compression stroke, the aspirated fuel is pumped into the pressure chamber 13 via the pressure line 10 and through the pressure valve 11, and after the valve needle 14 rises from its seat is injected via the injection openings 16 into the combustion chamber of the engine.

This high pressure prevailing during the compression stroke in the pump work chamber 9 is also propagated via the pressure line 26 and the relief conduit 18 and acts upon the valve element 20 of the relief valve 17, both on the spring side and on the valve seat side. The valve element 20 of the relief valve 17 therefore remains in its closed position, and the relief conduit 18 remains blocked.

At the end of the injection operation, initiated by the opening of the magnet valve 5, the pressure drop in the pump work chamber 9 effects the immediate closure of the pressure valve 11, as a result of which a high pressure is maintained in the pressure conduit 10' and in the relief conduit 18. Since the pressure in the pump work chamber 9 is now approximately zero, the relief valve 17 rises from its seat and uncovers the relief conduit 18, so that fuel flows out of the pressure chamber 13 and the pressure line 10' via the relief conduit 18 into the spring chamber 19 of the valve closing spring 15. The resultant pressure increase in the spring chamber 19, in addition to the closing force of the :losing spring 15, effects a force in the closing direction on the valve needle 14 and accelerates the closing operation.

That is, a pressure equalization takes place between the pressure chamber 13 and the spring chamber 19. At the same time, the pressure wave brought about by the cutoff operation is diverted into the spring chamber 19, where it exerts an additional force in the closing direction upon the valve needle 14.

After the closure of the valve needle 14, the noninjected fuel flows via the trottle 27, the annular chamber 28 and the housing bore 29 through a return line, not shown, to the reservoir, so that a pressure drop in the spring chamber 19 is assured. As soon as the increased pressure in the spring chamber 19, the relief conduit 18, the pressure conduit 10' and the pressure chamber 13 has been reduced via the throttle relief valve 17 closes again. This establishes the outset position for the next injection event.

The foregoing relates to a preferred exemplary embodiment of the invention, it being understood that other variants and embodiments thereof are possible with the sprit and scope of the invention, the latter being defined by the appended claims.

What is claimed and desired to be secured by letters patent of the United States is:

1. A fuel injection device for internal combustion engines comprising a housing, an injection pump (1) having a pump work chamber (9) in said housing, an injection nozzle having a valve needle (14) radially guided in said housing and loaded by a closing spring (15) and operative for controlling injection openings (16) branching off from a pressure chamber (13), a pressure line (10) between the pump work chamber and the pressure chamber (13), a relief conduit (18) connecting the pressure chamber to the spring chamber (19) of the closing spring, which relief conduit is controlled by a movable valve element (20), opening in the flow direction toward the spring chamber, of a relief valve (17) that is loaded by the pressure in the pump work chamber which blocks the relief conduit (18) during the high-pressure phase, a pressure valve (11) disposed in the pressure line (10), which opens toward the pressure chamber (13) and is loaded in a closing direction by a spring (12), whereby the movable valve element (20) of the relief valve (17) is already loaded in the opening direction by the pressure in the pressure chamber (13) in the high-pressure phase, so that simultaneously with a reduction of pressure in the pump work chamber (9) said movable valve element (20) opens in the flow direction toward the spring chamber (19).

2. A fuel injection device as defined by claim 1, in which said movable valve element (20) of said relief valve (17) is radially sealingly and axially displaceably guided and is provided on one side with a valve seat face (24) cooperating with a stationary valve seat (23) and on the other side is acted upon by fluid pressure of the pressure pump work chamber (9).

3. A fuel injection device as defined by claim 1, in which said movable valve element (20) of the relief valve (17) is urged in the closing direction by a spring (22).

4. A fuel injection device as defined by claim 2, in which said movable valve element (20) of the relief valve (17) is urged in the closing direction by a spring (22).

5. A fuel injection device as defined by claim 1, in which said relief valve (17) is disposed near the pump work chamber (9) in order to attain short line lengths.

6. A fuel injection device as defined by claim 2, in which said relief valve (17) is disposed near the pump work chamber (9) in order to attain short line lengths.

7. A fuel injection device as defined by claim 3, in which said relief valve (17) is disposed near the pump work chamber (9) in order to attain short line lengths.

8. A fuel injection device as defined by claim 1, which includes a leakage line from the spring chamber which connects with a return line.

9. A fuel injection device as defined by claim 2, which includes a leakage line from the spring chamber which connects with a return line.

10. A fuel injection device as defined by claim 3, which includes a leakage line from the spring chamber which connects with a return line.

11. A fuel injection device as defined by claim 5, which includes a leakage line from the spring chamber which connects with a return line.

12. A fuel injection device as defined by claim 1, in which said pressure valve (11) and said relief valve (17) are disposed parallel beside one another but operative in opposite directions in an intermediate plate, and that a seat face of the pressure valve (11) and a spring side of movable valve element (20) of the relief valve (17) are acted upon with pressure from the pump work chamber (9), and a seat face of the movable valve element (20) and the spring side of the pressure valve (11) are acted upon with pressure from the pressure chamber (13).

13. A fuel injection device as defined by claim 2, in which said pressure valve (11) and said relief valve (17) are disposed parallel beside one another but operative in opposite directions in an intermediate plate, and that a seat face of the pressure valve (11) and a spring side of movable valve element (20) of the relief valve (17) are acted upon with pressure from the pump work chamber (9), and a seat face of the movable valve element (20) and the spring side of the pressure valve (11) are acted upon with pressure from the pressure chamber (13).

14. A fuel injection device as defined by claim 3, in which said pressure valve (11) and said relief valve (17) are disposed parallel beside one another but operative in opposite directions in an intermediate plate, and that a seat face of the pressure valve (11) and a spring side of movable valve element (20) of the relief valve (17) are acted upon with pressure from the pump work chamber (9), and a seat face of the movable valve element (20) and the spring side of the pressure valve (11) are acted upon with pressure from the pressure chamber (13).

15. A fuel injection device as defined by claim 5, in which said pressure valve (11) and said relief valve (17) are disposed parallel beside one another but operative in opposite directions in an intermediate plate, and that a seat face of the pressure valve (11) and a spring side of movable valve element (20) of the relief valve (17) are acted upon with pressure from the pump work chamber (9), and a seat face of the movable valve element (20) and the spring side of the pressure valve (11) are acted upon with pressure from the pressure chamber (13).

16. A fuel injection device as defined by claim 8, in which said pressure valve (11) and said relief valve (17) are disposed parallel beside one another but operative in opposite directions in an intermediate plate, and that a seat face of the pressure valve (11) and a spring side of movable valve element (20 of the relief valve (17) are acted upon with pressure from the pump work chamber (9), and a seat face of the movable valve element (20) and the spring side of the pressure valve (11) are acted upon with pressure from the pressure chamber (13).

17. A fuel injection device as defined by claim 1, in which said injection pump and said injection nozzle form an integral unit.

18. A fuel injection device as defined by claim 2, in which said injection pump and said injection nozzle form an integral unit.

19. A fuel injection device as defined by claim 3, in which said injection pump and said injection nozzle form an integral unit.

20. A fuel injection device as defined in claim 1, which includes a control valve (5) in a pressure line from a pump (2) to the work chamber (9).

* * * * *